US011959723B2

(12) United States Patent
McPherson et al.

(10) Patent No.: US 11,959,723 B2
(45) Date of Patent: Apr. 16, 2024

(54) COMPOUND BOW WITH CABLE CHANGE

(71) Applicant: MCP IP, LLC, Sparta, WI (US)

(72) Inventors: Mathew A. McPherson, Norwalk, WI (US); Mark J. Hayes, Onalaska, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 17/866,297

(22) Filed: Jul. 15, 2022

(65) Prior Publication Data

US 2023/0013989 A1 Jan. 19, 2023

Related U.S. Application Data

(60) Provisional application No. 63/222,770, filed on Jul. 16, 2021.

(51) Int. Cl.
*F41B 5/14* (2006.01)
*F41B 5/10* (2006.01)

(52) U.S. Cl.
CPC ..... *F41B 5/1449* (2013.01); *F41B 5/105* (2013.01)

(58) Field of Classification Search
CPC ..... F41B 5/1449; F41B 5/105
USPC ..... 124/1, 86, 900, 25.6
See application file for complete search history.

(56) References Cited

U.S. PATENT DOCUMENTS 3,207,145 A * 9/1965 Browning ..... F41B 5/1449 124/88
3,294,078 A * 12/1966 Allen ..... F41B 5/1449 124/23.1
3,416,220 A * 12/1968 Wilsom ..... F41B 5/1449 29/446
4,032,111 A * 6/1977 Garrett ..... F41B 5/1449 124/90
4,074,409 A * 2/1978 Smith ..... F41B 5/1449 124/90
4,077,385 A * 3/1978 Fredrickson ..... F41B 5/1411 124/90
4,180,045 A * 12/1979 Kingsley ..... F41B 5/10 124/90
4,195,397 A * 4/1980 Saunders ..... F41B 5/1449 124/90
4,291,452 A * 9/1981 Whitman, Sr. ..... F41B 5/1449 124/90
4,599,987 A * 7/1986 Rezmer ..... F41B 5/1449 254/254
4,846,142 A * 7/1989 Tone ..... F41B 5/1449 124/90
5,125,389 A * 6/1992 Paff ..... F41B 5/1449 24/71.1

(Continued)

*Primary Examiner* — Alexander R Niconovich

(74) *Attorney, Agent, or Firm* — Laabs Intellectual Property

(57) ABSTRACT

In some embodiments, an archery bow comprises a riser, a first limb and a second limb. A first rotatable member is arranged to rotate about a first axis and a second rotatable member is arranged to rotate about a second axis. A bowstring is attached to the first rotatable member and arranged to bias the first rotatable member in a first rotational direction about the first axis. A power cable is attached to the first rotatable member. A servicing string is arranged for attachment to the first rotatable member and arranged to bias the first rotatable member in a second rotational direction about the first axis.

18 Claims, 11 Drawing Sheets

(56) References Cited

U.S. PATENT DOCUMENTS

| | | | | |
|---|---|---|---|---|
| 5,425,350 | A * | 6/1995 | Egusquiza | F41B 5/1449 124/1 |
| 5,606,963 | A | 3/1997 | Wenzel et al. | |
| 5,746,192 | A * | 5/1998 | Gissel | F41B 5/14 254/223 |
| 5,957,120 | A * | 9/1999 | Wiseby | F41B 5/14 124/86 |
| 6,957,647 | B2 * | 10/2005 | Evans | F41B 5/1449 124/1 |
| 7,089,923 | B2 * | 8/2006 | Johnson | F41B 5/10 124/1 |
| 7,913,680 | B2 * | 3/2011 | Evans | F41B 5/10 124/80 |
| 7,980,235 | B1 * | 7/2011 | Kronengold | F41B 5/14 124/1 |
| 8,733,333 | B2 * | 5/2014 | Barrios | F41B 5/1449 124/1 |
| 8,991,372 | B2 * | 3/2015 | Pirillo | F41B 5/1449 124/1 |
| 10,408,559 | B2 * | 9/2019 | Schuster | F41B 5/1449 |
| 10,767,957 | B2 * | 9/2020 | McPherson | F41B 5/1449 |
| 2011/0146644 | A1 | 6/2011 | Achkar | |
| 2013/0125871 | A1 * | 5/2013 | Pirillo | F41B 5/1449 124/86 |
| 2013/0205557 | A1 | 8/2013 | MacArthur | |
| 2014/0069407 | A1 | 3/2014 | Barrios | |
| 2016/0033228 | A1 | 2/2016 | McPherson | |
| 2018/0266786 | A1 * | 9/2018 | McPherson | F41B 5/1449 |

* cited by examiner

COMPOUND BOW WITH CABLE CHANGE

CROSS-REFERENCE TO RELATED APPLICATIONS

This application claims the benefit of U.S. patent application Ser. No. 63/222,770, filed Jul. 16, 2021, the entire content of which is hereby incorporated herein by reference.

BACKGROUND OF THE INVENTION

This invention relates generally to archery bows and more specifically to compound archery bows.

Compound bows are known in the art. Compound bows often include rotating members, a bowstring and at least one cable segment.

Servicing and maintenance of compound bows often requires a bow press, which tends to be a large machine capable of flexing the limbs of the bow to relieve tension from the bowstring and cable segments. Bow presses are often required in order to change bowstring and cable segments, to change cam track modules on rotatable members, etc.

There remains a need for novel archery bow designs that allow for servicing and maintenance of a compound bow without the need for a bow press.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a riser, a first limb and a second limb. A first rotatable member is arranged to rotate about a first axis and a second rotatable member is arranged to rotate about a second axis. A bowstring is attached to the first rotatable member and arranged to bias the first rotatable member in a first rotational direction about the first axis. A power cable is attached to the first rotatable member. A servicing string is arranged for attachment to the first rotatable member and arranged to bias the first rotatable member in a second rotational direction about the first axis.

In some embodiments, a length of the servicing string is less than a length of the power cable.

In some embodiments, the servicing string is attached to the riser. In some embodiments, the riser comprises a post and the servicing string is attached to the post.

In some embodiments, the servicing string is attached to the second rotatable member. In some embodiments, the servicing string crosses an axis plane that contains the first axis and the second axis.

In some embodiments, the first rotatable member comprises a first cable servicing post and the servicing string is attached to the first cable servicing post. In some embodiments, the second rotatable member comprises a first bowstring servicing post. In some embodiments, the second rotatable member comprises a second cable servicing post.

In some embodiments, an archery bow comprises a riser, a first limb, a second limb, a first rotatable member, a second rotatable member, a power cable, and a bowstring. The bowstring extends between the first rotatable member and the second rotatable member. The archery bow comprises a brace condition wherein the power cable is under tension. The archery bow comprises a servicing condition comprising a servicing string attached to the first rotatable member and to a secondary anchor, wherein the power cable is not under tension.

In some embodiments, the second rotatable member comprises the secondary anchor. In some embodiments, the riser comprises the secondary anchor.

In some embodiments, the bow comprises a second power cable under tension in the brace condition. In some embodiments, the archery bow comprises a second servicing condition wherein the servicing string is attached to the second rotatable member and to a secondary anchor, wherein the second power cable is not under tension.

In some embodiments, a method comprises providing an archery bow comprising a riser, a rotatable member, a secondary anchor, a bowstring engaged with the rotatable member and a power cable engaged with the rotatable member. Attaching a first portion of a servicing string to the rotatable member and attaching a second portion of the servicing string to the secondary anchor to reduce tension in the power cable. Removing the power cable from the archery bow.

In some embodiments, the method further comprises installing a replacement power cable on the archery bow.

In some embodiments, the method further comprises detaching the servicing string from the rotatable member and from the secondary anchor.

In some embodiments, the method comprises applying a force to the rotatable member while attaching the servicing string. In some embodiments, applying a force to the rotatable member comprises biasing the power cable.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
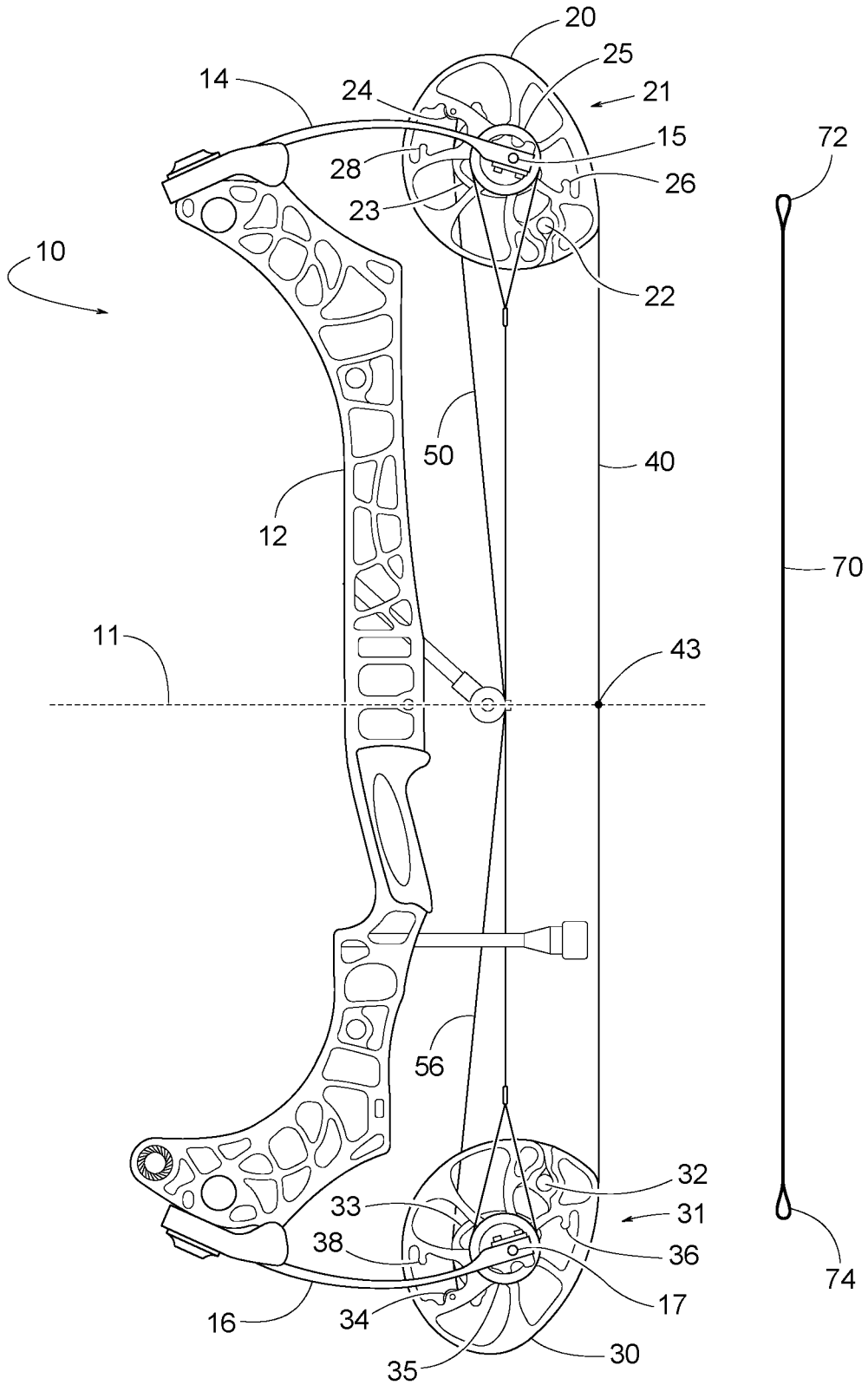
FIG. 1 shows an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow 10 comprising a first rotatable member 20, a second rotatable member 30, a bowstring 40 and at least one power cable 50. In some embodiments, a bow 10 comprises a second power cable 56.

In some embodiments, the first rotatable member 20 comprises a first servicing post 26 and a second servicing post 28. In some embodiments, the second rotatable member 30 comprises a third servicing post 36 and a fourth servicing post 38. In some embodiments, various servicing posts 26, 28, 36, 38 can be used with a servicing string 70 to change the bowstring 40 or the power cable(s) 50, 56 of the bow 10.

In some embodiments, an archery bow 10 comprises a riser 12, a first limb 14 supported by the riser 12 and a second limb 16 supported by the riser 12. In some embodiments, the first limb 14 supports the first rotatable member 20, which is arranged to rotate about a first axis 15. In some embodiments, the second limb 16 supports the second rotatable member 30, which is arranged to rotate about a second axis 17.

In some embodiments, the bow 10 defines a shooting axis 11. In some embodiments, the bowstring 40 comprises a nocking point 43, which may be aligned with the shooting axis 11.

In some embodiments, the first rotatable member 20 comprises a first bowstring track 21 and a first bowstring terminal 22. In some embodiments, the second rotatable member 30 comprises a second bowstring track 31 and a second bowstring terminal 32. In some embodiments, the bowstring 40 is attached between the rotatable members 20, 30. In some embodiments, the bowstring 40 comprises a first end comprising a first loop and a second end comprising a second loop. In some embodiments, the first loop of the bowstring 40 is attached to the first bowstring terminal 22 and the second loop is attached to the second bowstring terminal 32. Desirably, the bowstring 40 unspools from the respective bowstring tracks 21, 31 as the bow 10 is drawn.

In some embodiments, the first rotatable member 20 comprises a first cam track 23 and the first power cable 50 is arranged to be taken up by the first cam track 23 as the bow 10 is drawn. In some embodiments, the first rotatable member 20 comprises a first power cable terminal 24. In some embodiments, a first end of the first power cable 50 is attached to the first power cable terminal 24 and the first power cable 50 extends toward the second rotatable member 30. In some embodiments, the first power cable 50 attaches to the second rotatable member 30, although the first power cable 50 can also attach to an axle, to the second limb 16, or any other suitable portion of the bow 10. As shown in FIG. 1, the second rotatable member 30 comprises a first force vectoring anchor 35, and a second end of the first power cable 50 is attached to the first force vectoring anchor 35.

In some embodiments, the archery bow 10 comprises a second power cable 56. In some embodiments, the second rotatable member 30 comprises a second cam track 33 and the second power cable 56 is arranged to be taken up by the second cam track 33 as the bow 10 is drawn. In some embodiments, the second rotatable member 30 comprises a second power cable terminal 34. In some embodiments, a first end of the second power cable 56 is attached to the second power cable terminal 34 and the second power cable 56 extends toward the first rotatable member 20. In some embodiments, the second power cable 56 attaches to the first rotatable member 20, although the second power cable 56 can also attach to an axle, to the first limb 14, or any other suitable portion of the bow 10. As shown in FIG. 1, the first rotatable member 20 comprises a second force vectoring anchor 25, and a second end 59 of the second power cable 56 is attached to the second force vectoring anchor 25.

In some embodiments, force applied by the bowstring 40 to the first rotatable member 20 generally biases the first rotatable member 20 in a first rotational direction (e.g. clockwise) about the first axis 15. In some embodiments, force applied by the first power cable 50 to the first rotatable member 20 generally biases the first rotatable member 20 in a second rotational direction (e.g. counter-clockwise) about the first axis 15.

In some embodiments, force applied by the bowstring 40 to the second rotatable member 30 generally biases the second rotatable member 30 in the second rotational direction (e.g. counter-clockwise) about the second axis 17. In some embodiments, force applied by the second power cable 56 to the second rotatable member 30 generally biases the second rotatable member 30 in the first rotational direction (e.g. clockwise) about the second axis 17.

In some embodiments, the first servicing post 26 comprises a first bowstring servicing post 26. In some embodiments, the second servicing post 28 comprises a first cable servicing post 28. In some embodiments, the third servicing post 36 comprises a second bowstring servicing post 36. In some embodiments, the fourth servicing post 38 comprises a second cable servicing post 38. A servicing post 26, 28, 36, 38 can have any suitable size, shape or configuration. In some embodiments, a servicing post 26, 36 comprises a stem and an enlarged flange portion.

In some embodiments, a servicing string 70 is provided with the bow 10. In some embodiments, a servicing string 70 comprises a tool that allows a user to change a bowstring 40 and/or the power cable(s) 50, 56 without any other tools. In some embodiments, a length of the servicing string 70 is less than a length of the bowstring 40. In some embodiments, a length of the servicing string 70 is less than a distance between the first axis 15 and the second axis 17. In some embodiments, a length of the servicing string 70 is less than a length of the first power cable 50 or the second power cable 56.

In some embodiments, a first end 72 of the servicing string 70 is arranged to engage the first rotatable member 20 and a second end 74 of the servicing string 70 is arranged to engage a secondary anchor of the bow 10. In some embodiments, the second rotatable member 30 comprises the secondary anchor and the servicing string 70 engages the second rotatable member 30. In some embodiments, each end 72, 74 of the servicing string 70 comprises a hook, a loop, or another suitable shape. In some embodiments, an end 72, 74 of the servicing string 70 is arranged to engage a servicing post 26, 28, 36, 38.

In some embodiments, the archery bow 10 comprises an undrawn or brace condition, for example as shown in FIG. 1. Desirably, in the brace condition, the bowstring 40 and the first power cable 50 are each loaded in tension. In embodiments of a bow 10 that comprise a second power cable 56, desirably the second power cable 56 is loaded in tension in the brace condition.

In some embodiments, a length of the servicing string 70 is less than a distance between the first bowstring servicing post 26 and the second bowstring servicing post 36 when the bow 10 is in the brace condition.

In some embodiments, a length of the servicing string 70 is less than a distance between the first bowstring servicing post 26 and the second cable servicing post 38 when the bow 10 is in the brace condition.

In some embodiments, a length of the servicing string 70 is less than a distance between the second bowstring servicing post 36 and the first cable servicing post 28 when the bow 10 is in the brace condition.

Figure 2:
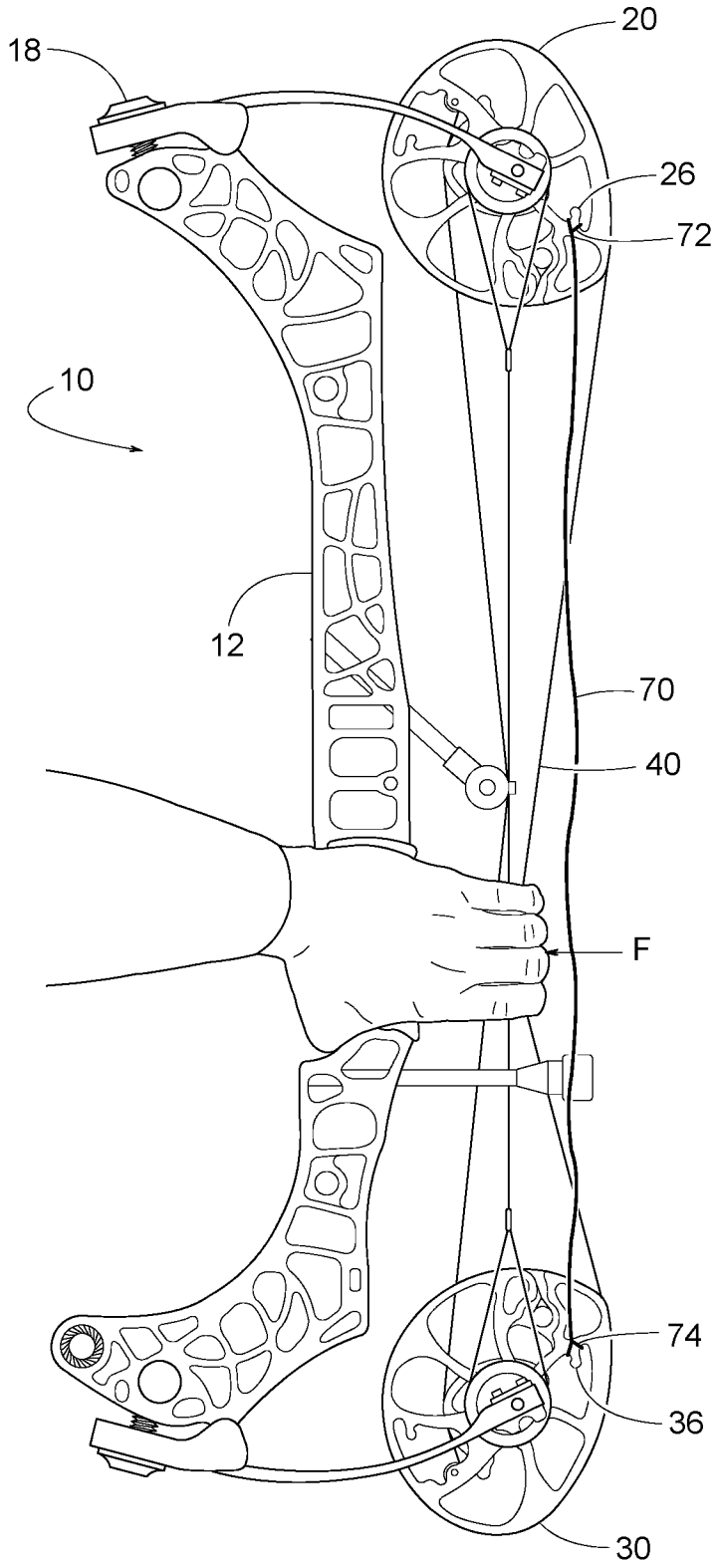
FIG. 2 shows an embodiment of a bow during installation of an embodiment of a servicing string.
Figure 3:
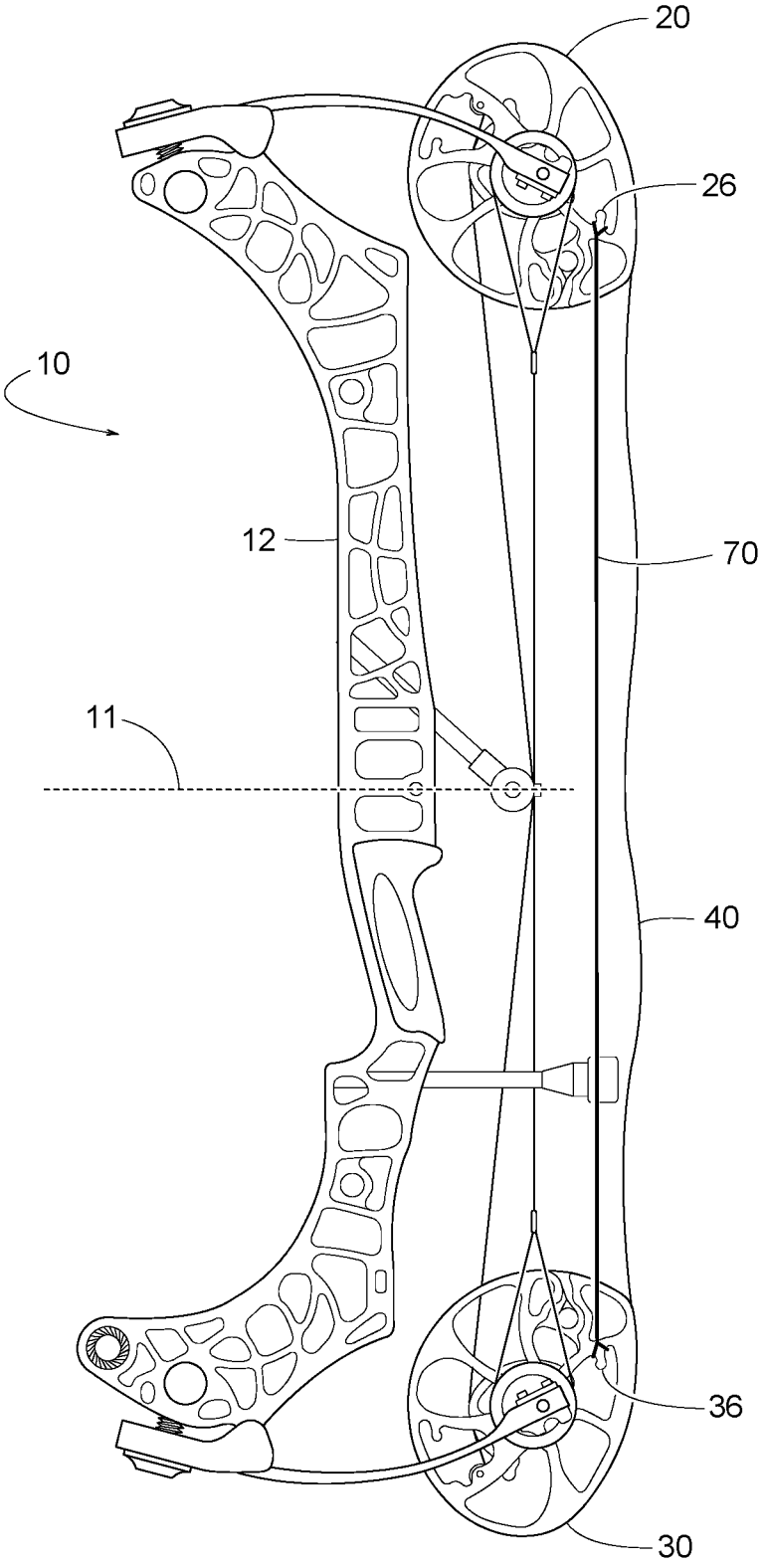
FIG. 3 shows a servicing string being used to change a bowstring.

FIGS. 2 and 3 show an example of using an embodiment of a servicing string 70 to change a bowstring 40. In some embodiments, the servicing string 70 can be arranged to load the first rotatable member 20 and the second rotatable member 30 in a way that relieves tension on the bowstring 40.

In some embodiments, the rotatable members 20, 30 can each be rotated enough to install the servicing string 70 between the rotatable members 20, 30. For example, as shown in FIG. 2, an external force F can be applied to the bowstring 40 that results in rotation of the rotatable members 20, 30. FIG. 2 shows the bowstring 40 being pulled toward the riser 12, but alternatively the bowstring 40 could be pulled away from the riser. In some embodiments, one or more limb fasteners 18 can be loosened, which may reduce the total amount of tension present in the bowstring 40 and cable(s) 50, 56. With the rotatable members 20, 30 rotated slightly from their brace condition orientations, the servicing string 70 can be attached to the first rotatable member 20 and to the second rotatable member 30, for example by engaging the first end 72 of the servicing string 70 with the first bowstring servicing post 26 and engaging the second end 74 of the servicing string 70 with the second bowstring servicing post 36. The external force F applied to the bowstring 40 can be removed, allowing the rotatable members 30, 40 to begin rotation back toward their brace orientations, which will load the servicing string 70 in tension. Desirably, the servicing string 70 is sized to hold the rotatable members 20, 30 at an orientation where the bowstring 40 is slack.

FIG. 3 shows an embodiment of an archery bow 10 with the servicing string 70 installed between the bowstring servicing posts 26, 36. The servicing string 70 is under tension, carrying the tension ordinarily carried by the bowstring 40, which allows the bowstring 40 to be slack (e.g. the bowstring 40 is not under a tensile load). The bowstring 40 can be removed from the bow 10 and a new bowstring 40 can be installed. The servicing string 70 can be removed by applying an external force F to the bowstring 40 and disengaging the servicing string 70 from the rotatable members 20, 30.

Figure 4:
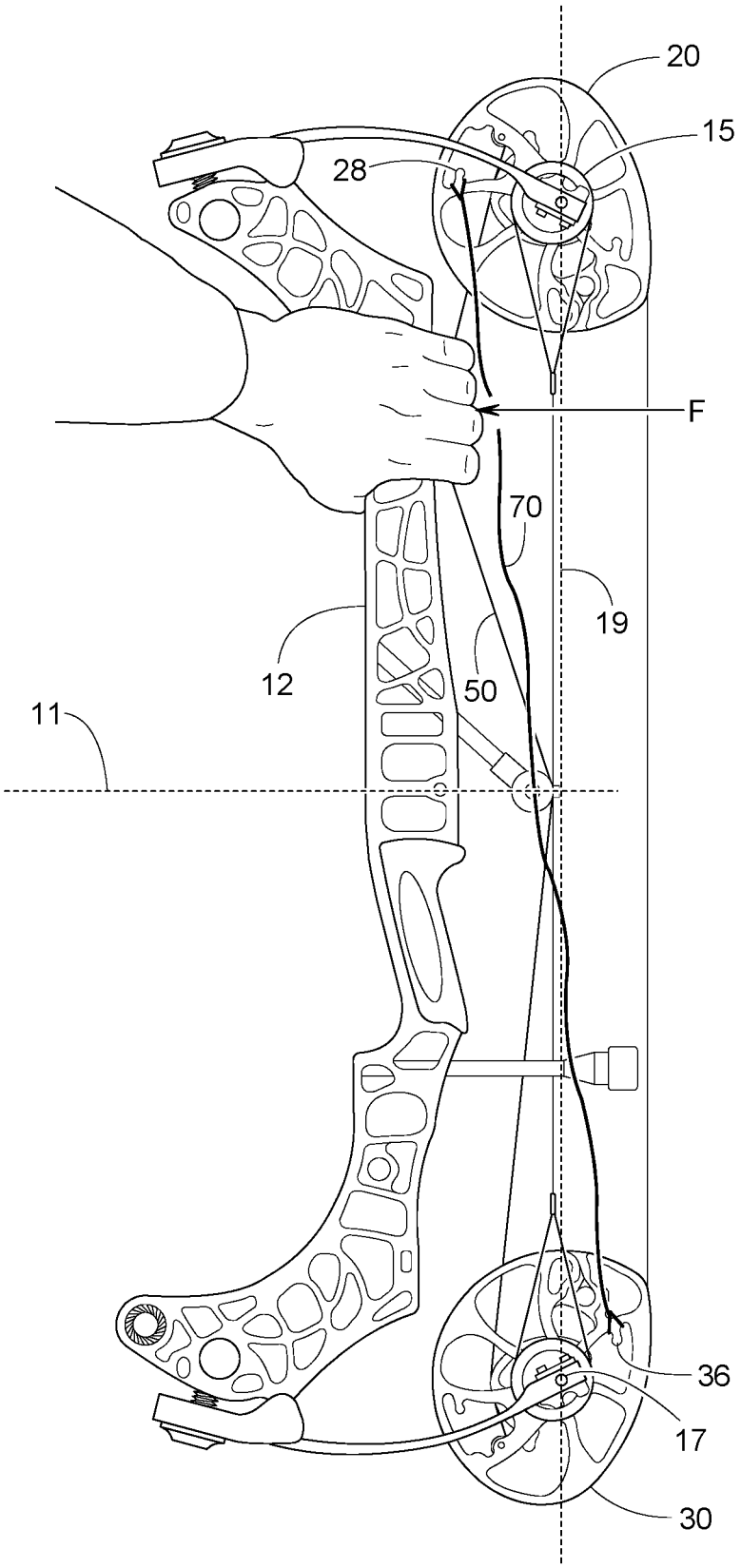
FIG. 4 shows an embodiment of a bow during installation of a servicing string in another orientation.
Figure 5:
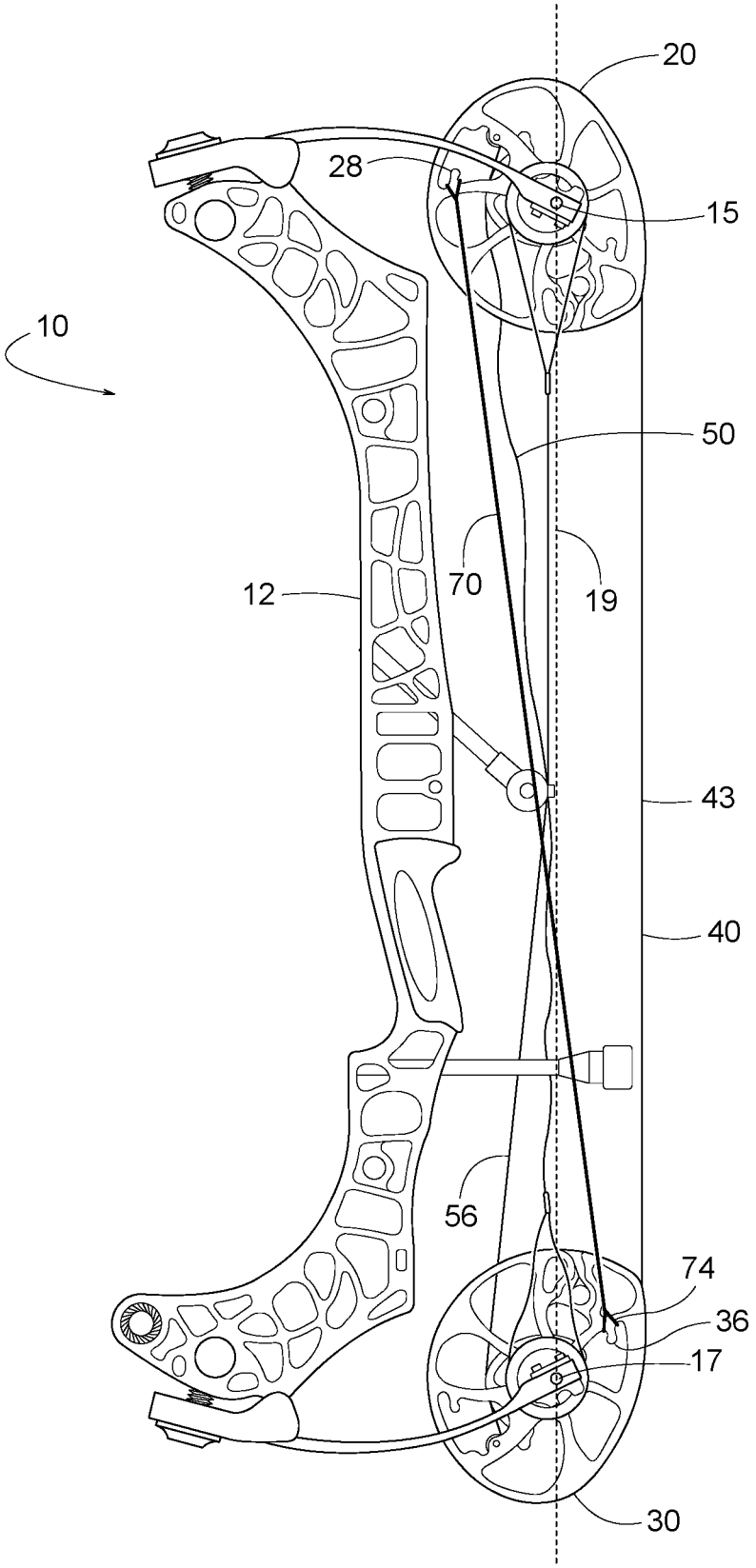
FIG. 5 shows a servicing string being used to change a first power cable.

FIGS. 4 and 5 show an example of using the servicing string 70 to change a power cable 50. In some embodiments, the servicing string 70 can be arranged to load the first rotatable member 20 in a way that relieves tension on a power cable 50. In some embodiments, the servicing string 70 extends to the second rotatable member 30.

In some embodiments, the archery bow 10 defines an axis plane 19 that contains the first axis 15 and the second axis 17. In some embodiments, the rotatable members 20, 30 can be manipulated to allow installation of the servicing string 70 between the rotatable members 20, 30 with the servicing string crossing the axis plane 19.

In some embodiments, an external force F can be applied to the first power cable 50, which results in movement of at least one rotatable member 20, 30. For example, FIG. 4 shows the first power cable 50 being pulled toward the riser 12. In some embodiments, the servicing string 70 can be attached to the first rotatable member 20 and to a secondary anchor of the bow 10, for example by engaging the first end 72 of the servicing string 70 with the first cable servicing post 28 and engaging the second end 74 of the servicing string 70 with a secondary anchor positioned away from the first rotatable member 20. In some embodiments, the second bowstring servicing post 36 comprises the secondary anchor and the servicing string 70 is attached to the second bowstring servicing post 36. The external force F applied to the first power cable 50 can be removed, which will load the servicing string 70 in tension. Desirably, the servicing string 70 is sized to hold the rotatable members 20, 30 at an orientation where the first power cable 50 is slack.

FIG. 5 shows an embodiment of an archery bow 10 in a cable servicing orientation. In some embodiments, the servicing string 70 is installed between the first cable servicing post 28 and the second bowstring servicing post 36. The servicing string 70 crosses the axis plane 19. The bowstring 40 and the second power cable 56 are under tension. The servicing string 70 is under tension, which allows the first power cable 50 to be slack (e.g. the first power cable 50 is not under a tensile load). Force applied by the bowstring 40 to the first rotatable member 20 biases the first rotatable member 20 in the first rotational direction (e.g. clockwise) about the first axis 15. Force applied by the servicing string 70 to the first rotatable member 20 biases the first rotatable member 20 in the second rotational direction (e.g. counterclockwise) about the first axis 15. In some embodiments, the first power cable 50 does not apply a rotational force to the first rotatable member 20 in the cable servicing orientation. The first power cable 50 can be removed from the bow 10 and a new first power cable 50 can be installed. The servicing string 70 can be removed by applying an external force F to the first power cable 50 and disengaging the servicing string 70 from the rotatable members 20, 30.

Figure 6:
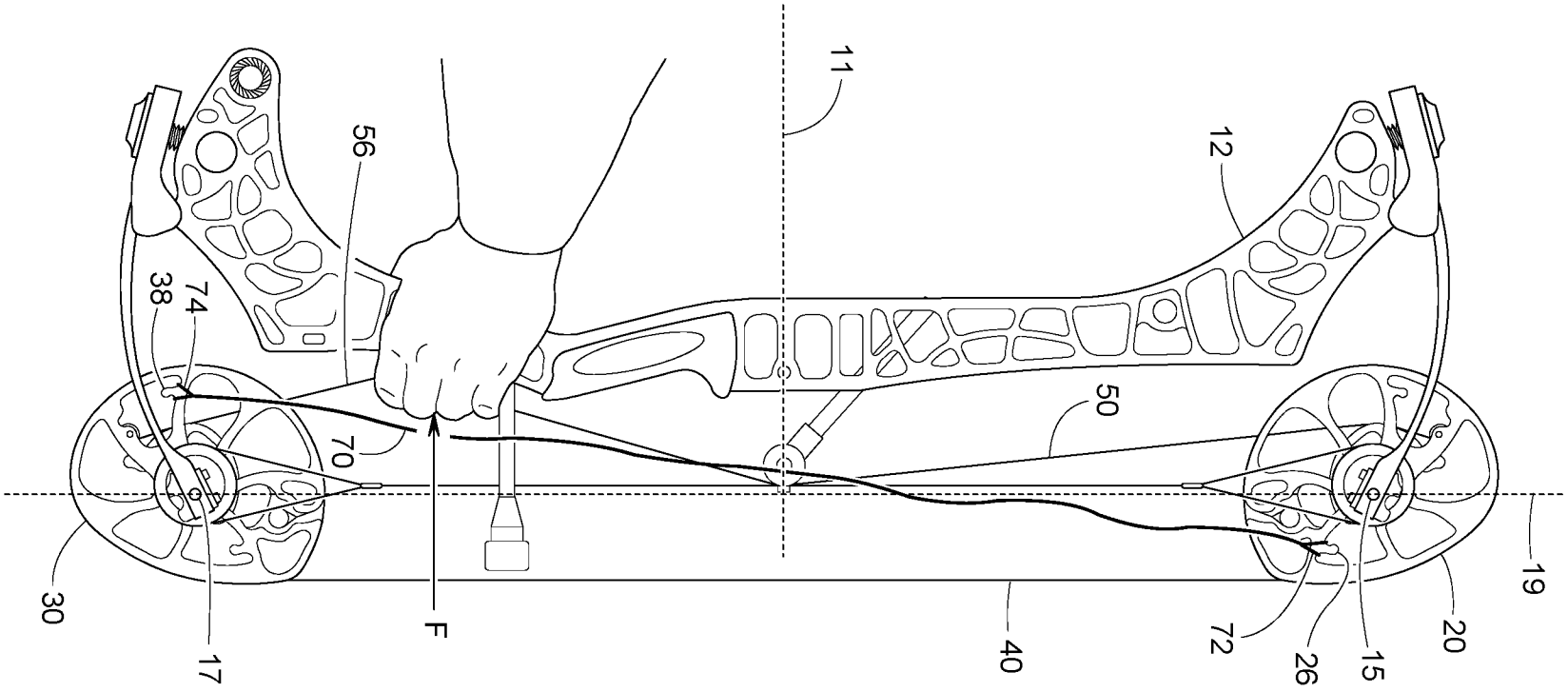
FIG. 6 shows an embodiment of a bow during installation of a servicing string in another orientation.
Figure 7:
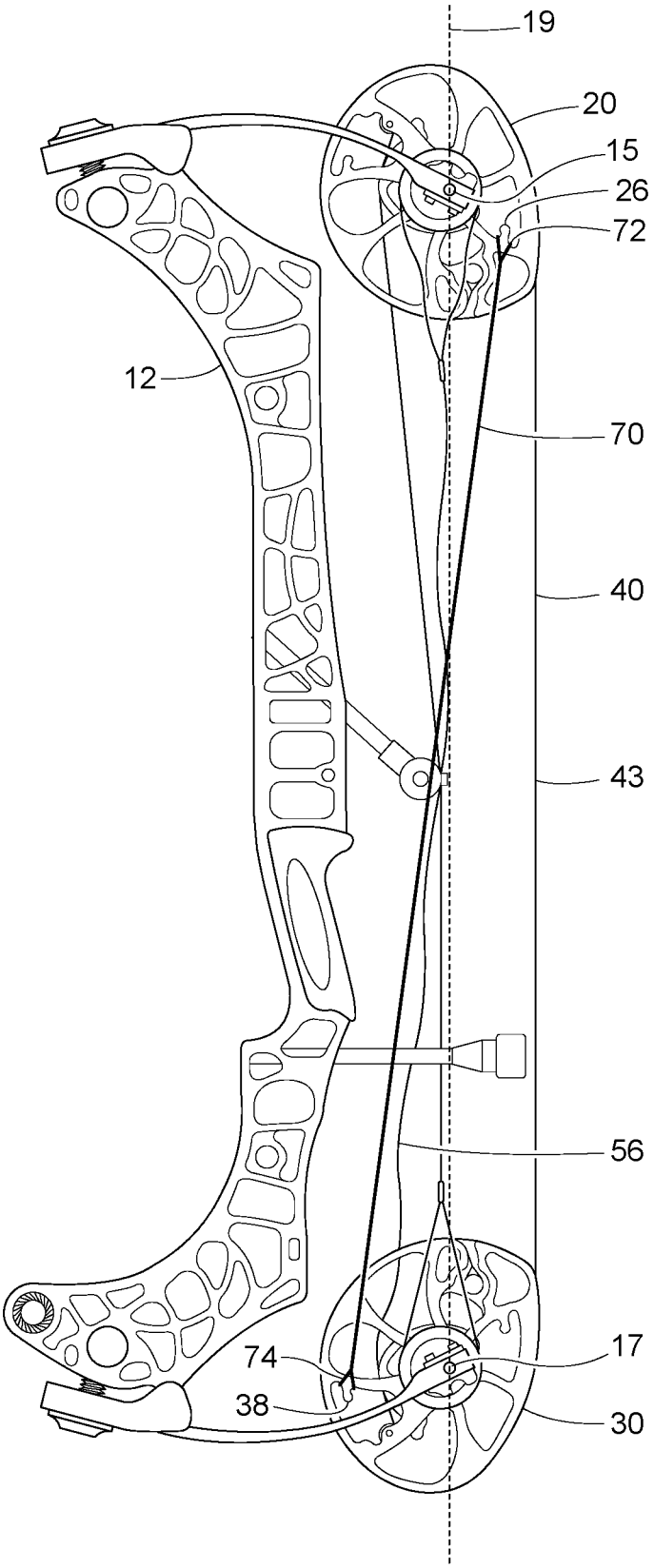
FIG. 7 shows a servicing string being used to change a second power cable.

FIGS. 6 and 7 show an example of using the servicing string 70 to change a second power cable 56. In some embodiments, the servicing string 70 can be arranged to load the second rotatable member 30 in a way that relieves tension on the second power cable 56.

In some embodiments, an external force F can be applied to the second power cable 56, which results in movement of at least one rotatable member 20, 30. For example, FIG. 6 shows the second power cable 56 being pulled toward the riser 12. In some embodiments, the servicing string 70 can be attached to the second rotatable member 30 and to a secondary anchor of the bow 10, for example by engaging the second end 74 of the servicing string 70 with the second cable servicing post 38 and engaging the first end 72 of the servicing string 70 with the secondary anchor. In some embodiments, the secondary anchor comprises the first bowstring servicing post 26 and the servicing string 70 is engaged with the first bowstring servicing post 26. The external force F applied to the second power cable 56 can be removed, which will load the servicing string 70 in tension.

Desirably, the servicing string 70 is sized to hold the second rotatable member 30 at an orientation where the second power cable 56 is slack.

FIG. 7 shows an embodiment of an archery bow 10 in a second cable servicing orientation. In some embodiments, the servicing string 70 is installed between the second cable servicing post 38 and the first bowstring servicing post 26. The servicing string 70 crosses the axis plane 19. The bowstring 40 and the first power cable 50 are under tension. The servicing string 70 is under tension, which allows the second power cable 56 to be slack (e.g. the second power cable 56 is not under a tensile load). Force applied by the bowstring 40 to the second rotatable member 30 biases the second rotatable member 30 in the second rotational direction (e.g. counter-clockwise) about the second axis 17. Force applied by the servicing string 70 to the second rotatable member 30 biases the second rotatable member 30 in the first rotational direction (e.g. clockwise) about the second axis 17. In some embodiments, the second power cable 56 does not apply a rotational force to the second rotatable member 30 in the second cable servicing orientation. The second power cable 56 can be removed from the bow 10 and a new second power cable 56 can be installed. The servicing string 70 can be removed by applying an external force F to the second power cable 56 and disengaging the servicing string 70 from the rotatable members 20, 30.

Figure 8:
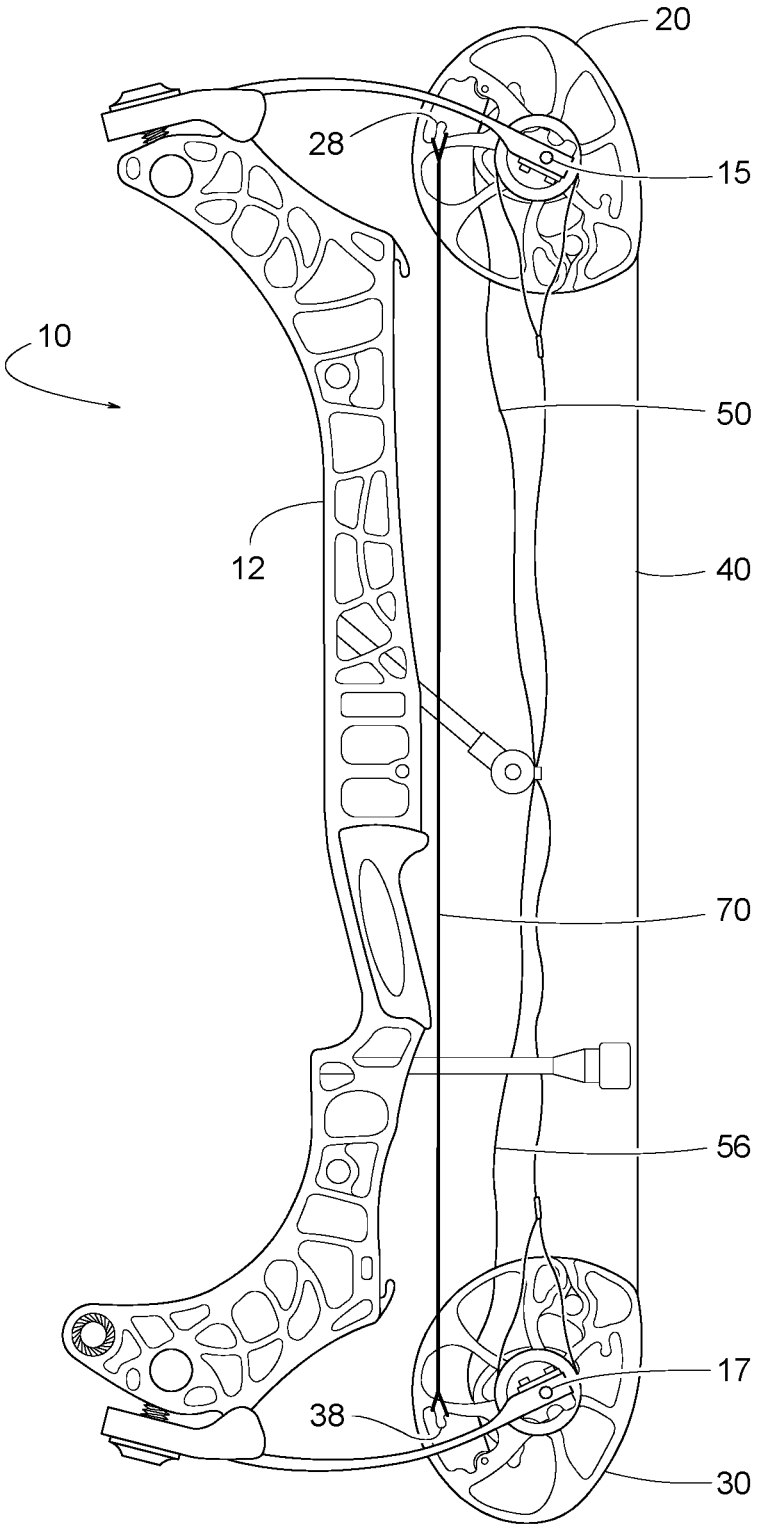
FIG. 8 shows a servicing string being used to change a first power cable and a second power cable.

FIG. 8 shows an embodiment of an archery bow 10 in a third cable servicing orientation. In some embodiments, the servicing string 70 is attached between the first cable servicing post 28 and the second cable servicing post 38, which can relieve tension on both the first power cable 50 and the second power cable 56 simultaneously. In some embodiments, the bowstring 40 biases the first rotatable member 20 in the first rotational direction (e.g. clockwise) about the first axis 15 and biases the second rotatable member 30 in the second rotational direction (e.g. counter-clockwise) about the second axis 17. In some embodiments, the servicing string 70 biases the first rotatable member 20 in the second rotational direction (e.g. counter-clockwise) about the first axis 15 and biases the second rotatable member 30 in the first rotational direction (e.g. clockwise) about the second axis 17.

In some embodiments, when the servicing string 70 is installed between the first cable servicing post 28 and the second cable servicing post 38, the first power cable 50 is not under tension and the second power cable 56 is not under tension. Thus, in the third cable servicing orientation, both the first power cable 50 and the second power cable 56 can be changed.

Figure 9:
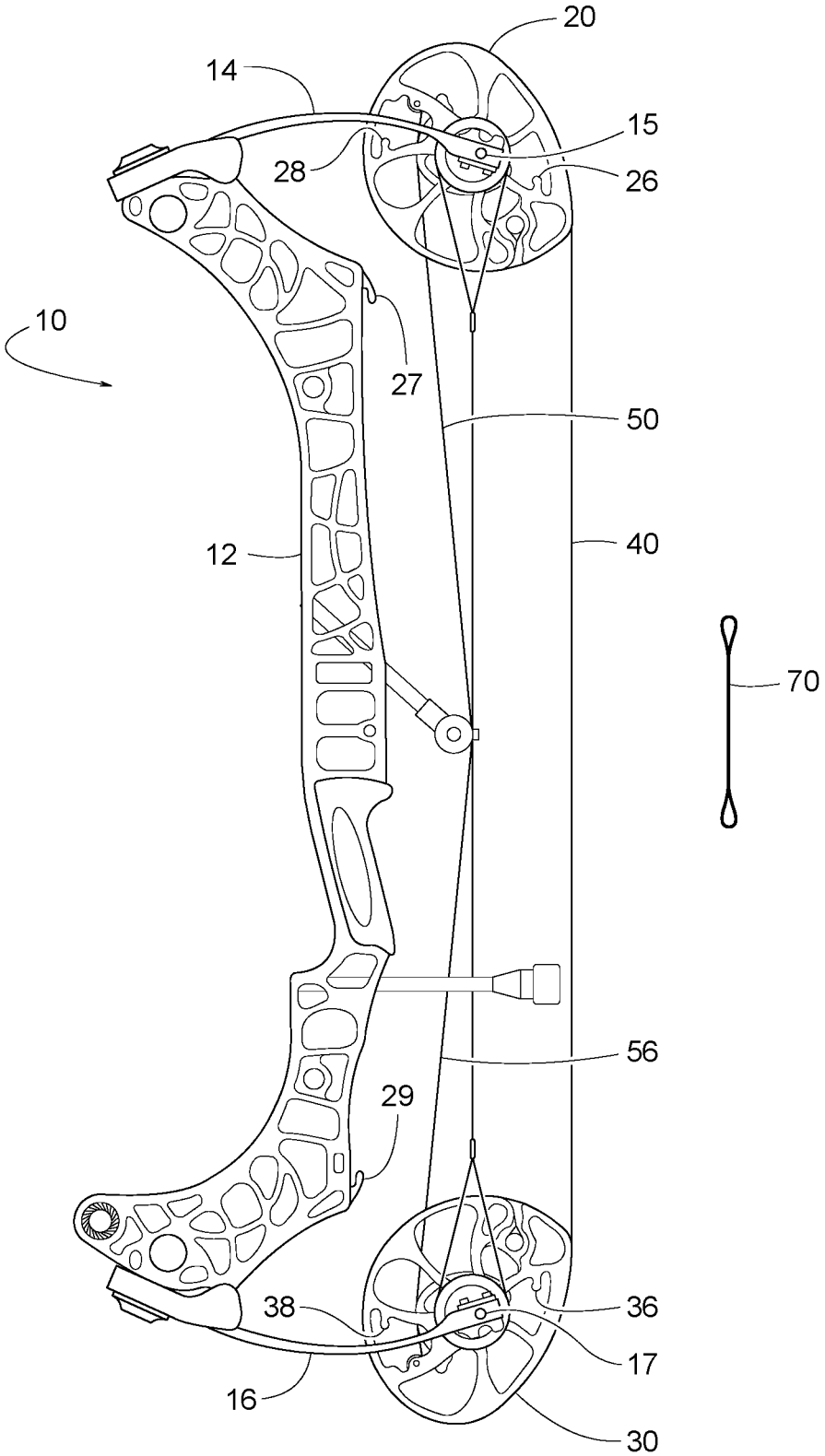
FIG. 9 shows another embodiment of an archery bow.

FIG. 9 shows another embodiment of an archery bow 10. In some embodiments, a rotatable member 20 comprises a cable servicing post 28 and the bow 10 comprises a secondary anchor 27 that is spaced apart from the rotatable member 20. The secondary anchor 27 can be provided on any other suitable portion of the bow 10, such as a limb 14, 16, the riser 12 or any other suitable portion.

FIG. 9 shows a bow 10 comprising a riser 12 comprising a first secondary anchor 27 and a second secondary anchor 29. FIG. 9 shows another embodiment of a servicing string 70.

Figure 10:
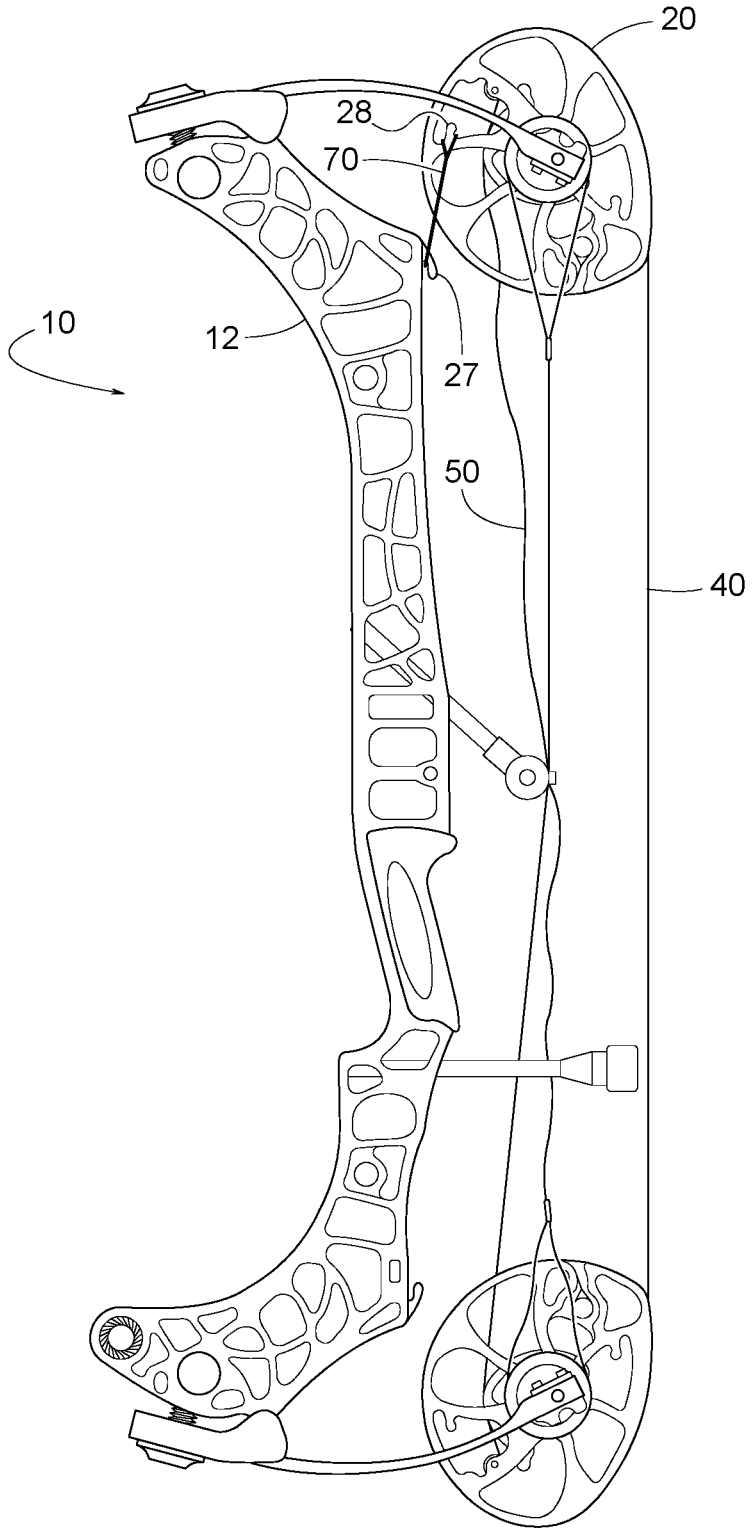
FIG. 10 shows an embodiment of a servicing string being used to change a first power cable.

FIG. 10 shows the bow 10 of FIG. 9 in a first servicing condition wherein the servicing string 70 is attached between the first cable servicing post 28 of the first rotatable member 20 and the first secondary anchor 27 of the riser 12. Force applied to the first rotatable member 20 by the servicing string 70 relieves tension in the first power cable 50.

Figure 11:
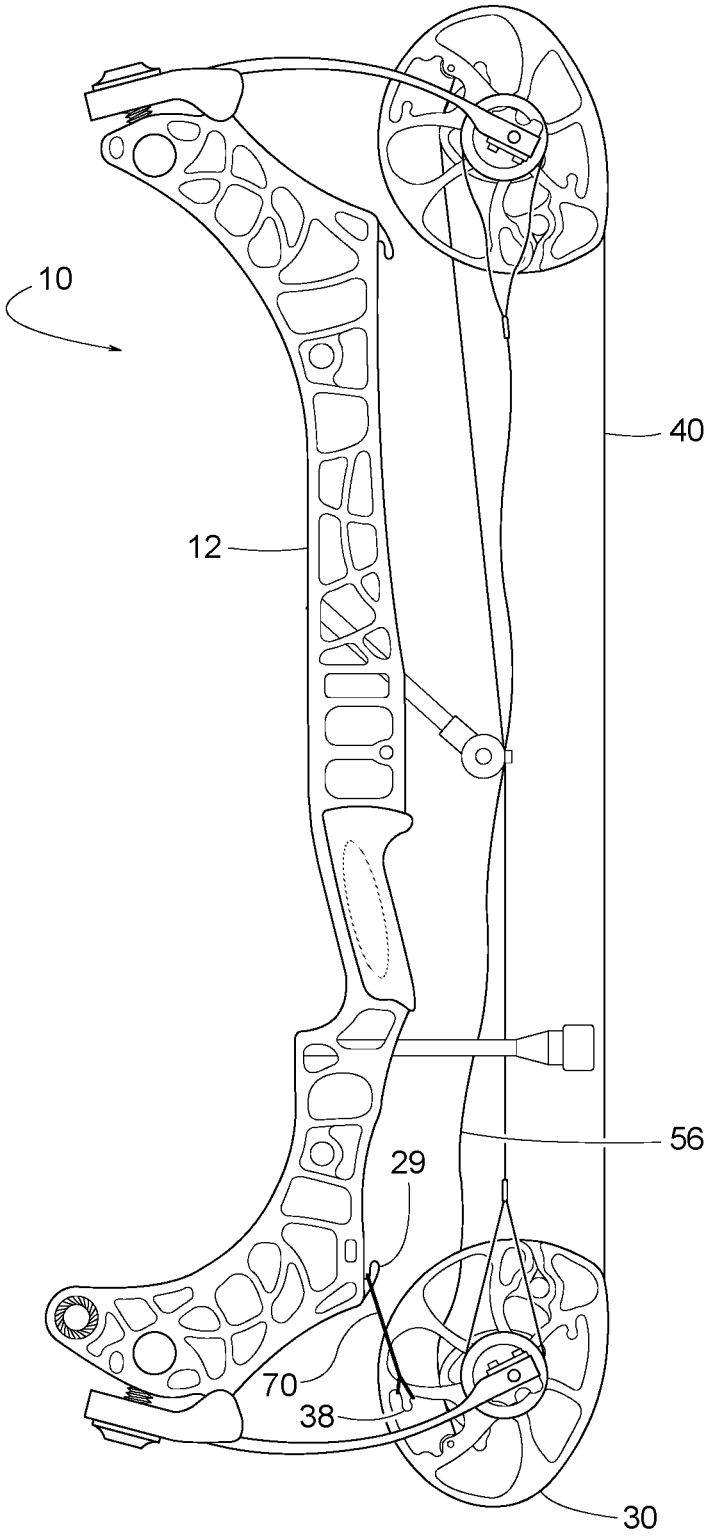
FIG. 11 shows an embodiment of a servicing string being used to change a second power cable.

FIG. 11 shows the bow 10 of FIGS. 9 and 10 in a second servicing condition wherein the servicing string 70 is attached between the second cable servicing post 38 of the second rotatable member 30 and the second secondary anchor 29 of the riser 12. Force applied to the second rotatable member 30 by the servicing string 70 relieves tension in the second power cable 56.

The servicing string 70 can be made of any suitable material and can have any suitable configuration. In some embodiments, the servicing string 70 acts as a tension member when used to service the bow 10. In some embodiments, the servicing string 70 comprises a material similar to the material of the bowstring 40, such as a polymeric material or materials disclosed in U.S. Pat. No. 7,231,915, the entire disclosure of which is hereby incorporated herein by reference.

In some embodiments, the first bowstring servicing post 26 and the second bowstring servicing post 36 are each located to a first side of the axis plane 19. In some embodiments, the nocking point 43 is located to the first side of the axis plane 19. In some embodiments, the first cable servicing post 28 and the second cable servicing post 38 are each located to a second side of the axis plane 19. In some embodiments, the riser 12 is located to the second side of the axis plane 19.

U.S. Pat. No. 10,767,957 is hereby incorporated herein by reference in its entirety.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow comprising:

a riser, a first limb and a second limb;

a first rotatable member arranged to rotate about a first axis;

a second rotatable member arranged to rotate about a second axis;

a bowstring attached to the first rotatable member, the bowstring arranged to rotate the first rotatable member in a first rotational direction about the first axis when a draw force is applied to the bowstring;

a power cable attached to the first rotatable member; and a servicing string attached to the first rotatable member, the servicing string arranged to rotate the first rotatable member in a second rotational direction about the first axis, the second direction opposite to the first direction.

2. The archery bow of claim 1, wherein a length of the servicing string is less than a length of the power cable.

3. The archery bow of claim 1, the servicing string attached to the riser.

4. The archery bow of claim 3, the riser comprising a post, the servicing string attached to the post.

5. The archery bow of claim 1, the servicing string attached to the second rotatable member.

6. The archery bow of claim 5, the servicing string crossing an axis plane that contains the first axis and the second axis.

7. The archery bow of claim 1, the first rotatable member comprising a first cable servicing post, the servicing string attached to the first cable servicing post.

8. The archery bow of claim 7, the second rotatable member comprising a first bowstring servicing post.

9. The archery bow of claim 7, the second rotatable member comprising a second cable servicing post.

10. The archery bow of claim 1, comprising a servicing condition wherein the servicing string is attached to the first rotatable member and to a secondary anchor, wherein the power cable is not under tension.

11. The archery bow of claim 10, wherein the second rotatable member comprises the secondary anchor.

12. The archery bow of claim 10, wherein the riser comprises the secondary anchor.

13. The archery bow of claim 10, wherein a length of the servicing string is less than a length of the power cable.

14. The archery bow of claim 13, the servicing string crossing an axis plane, the axis plane containing the first axis and the second axis.

15. The archery bow of claim 10, the first rotatable member comprising a first cable servicing post, the servicing string attached to the first cable servicing post.

16. The archery bow of claim 15, the second rotatable member comprising a first bowstring servicing post.

17. The archery bow of claim 15, the second rotatable member comprising a second cable servicing post.

18. The archery bow of claim 10, comprising a second power cable, the second power cable under tension in a brace condition, the archery bow comprising a second servicing condition wherein the servicing string is attached to the second rotatable member and to a secondary anchor, wherein the second power cable is not under tension.

* * * * *